United States Patent [19]

Bredow

[11] 4,446,609

[45] May 8, 1984

[54] A TOOL FOR EXCHANGING A MATRIX IN A METAL WORKING MACHINE

[75] Inventor: Walter Bredow, Alfeld, Fed. Rep. of Germany

[73] Assignee: C. Behrens AG, Alfeld, Fed. Rep. of Germany

[21] Appl. No.: 421,117

[22] Filed: Sep. 20, 1982

Related U.S. Application Data

[62] Division of Ser. No. 226,154, Jan. 19, 1981.

[30] Foreign Application Priority Data

Feb. 12, 1980 [DE] Fed. Rep. of Germany ..... 3005089

[51] Int. Cl.[3] ..... B25B 27/00

[52] U.S. Cl. ..... 29/270; 29/278

[58] Field of Search ..... 29/278, 270, 764; 81/428 PG; 269/238

[56] References Cited

U.S. PATENT DOCUMENTS

| | | | |
|---|---|---|---|
| 2,518,994 | 8/1950 | Miller | 81/428 PG |
| 3,315,341 | 4/1967 | Lard | 29/278 |
| 3,398,445 | 8/1968 | Westendorf et al. | 29/270 |
| 3,426,954 | 2/1969 | Tureskis | 29/278 |
| 4,290,193 | 9/1981 | Anderton et al. | 29/278 |

*Primary Examiner*—Robert C. Watson

*Attorney, Agent, or Firm*—Michael J. Striker

[57] ABSTRACT

A matrix releasably mounted on an elongated matrix shoe is pressed by end faces of a pair of spring-biased clamping levers tiltable at outer ends about axes parallel to the axis of the matrix against an upwardly extending abutment face of the shoe, and a tool including a slide movable between the clamping levers to spread the same apart and having a withdrawal lever tiltable above the slide about an axis extending transverse to the latter and carrying a pin arranged to enter a catch bore provided in the matrix for withdrawing the matrix in the direction of the elongation of the shoe from the latter.

2 Claims, 4 Drawing Figures

A TOOL FOR EXCHANGING A MATRIX IN A METAL WORKING MACHINE

This is a division of application Ser. No. 226,154, filed Jan. 19, 1981.

BACKGROUND OF THE INVENTION

The present invention relates to an arrangement for exchangeably mounting a matrix of circular cross-section of a tool in a metal working machine, especially in the turntable of a revolving cutting press including a matrix shoe provided with an elongated cutout open toward the outer surface of the turntable, in which the matrix is located and pressed with part of its peripheral surface by a releasable clamping arrangement against an abutment face of the cutout formed in accordance to the peripheral surface of the matrix, as well as a tool for use in arrangement of the aforementioned kind for exchanging the matrix.

In a known arrangement of the aforementioned kind the matrixes are respectively placed into a half-circular cutout provided in the matrix shoe and clamped by a clamping bridge by means of screws. The matrixes are secured against turning by pins provided either in the matrix or in the matrix shoe. Such a holding arrangement has the disadvantage that for exchange of a matrix a series of manually performed operations are necessary, especially in order to unscrew the screws to remove the clamping bridge, then to manually remove the matrix, to manually insert a new matrix into cutout and finally to mount the clamping bridge again with the screws to clamp the matrix in the cutout. Since in many applications, and especially during the production of small size lots different tools are to be mounted on the press, there will result excessive idle times for the machine, which during use of the described known clamping arrangement can be considerable.

SUMMARY OF THE INVENTION

The present invention is used for metal working machines including at least one matrix, especially for revolving cutting presses with turntables.

It is an object of the present invention to provide an arrangement of the aforementioned kind as well as for a tool for exchanging the matrix, which overcomes the disadvantages of such arrangements known in the art.

It is a further object of the present invention to provide an arrangement for releasably clamping a matrix in a cutout of a matrix shoe and a tool for releasing and exchanging the matrix by means of which the exchange of the matrix can be facilitated and especially accelerated so that the idle times of the machines can be reduced to a considerable extent.

With these and other objects in view, which will become apparent as the description proceeds, the arrangement of the present invention mainly comprises a matrix having a peripheral surface, a matrix shoe adapted to be mounted on the tool holder of a metal working machine, especially on the turntable of a revolving cutting press, in which the shoe is provided with an elongated cutout having an open end and opposite the open end an upwardly extending abutment face corresponding to part of the peripheral surface of the matrix and the matrix is located in the cutout with part of its peripheral surface abutting against the abutment face, and releasable clamping means in the cutout spaced from the abutment face and movable between a clamping position pressing the matrix against the abutment face and a releasing position, in which the clamping means are constructed and arranged to permit in the releasing position withdrawal of the matrix from the shoe in the direction of the elongation of the cutout.

The aforementioned clamping means preferably comprise a pair of levers arranged mirror-symmetrical with respect to a longitudinal axis of the shoe and having inner end faces engaging in the locking position of the clamping means portions of the peripheral surface of the matrix opposite the abutment face and outer ends pivotable about axes parallel to the axis of the matrix, and spring means for biasing the levers to the locking position.

The inner end faces of the clamping levers are arranged in the locking position so that lines connecting the pivot axes with the axis of the matrix intersect said inner faces or at least pass through inner end edges of the respective engaging faces.

The matrix is preferably provided at the side thereof facing the clamping levers with a catch bore extending parallel to the axis of the matrix for a purpose which will be described later on.

To assure a secure position of the matrix and to facilitate its withdrawal it is also advantageous, according to a further feature of the present invention to arrange the matrix in the matrix shoe abutting with a lower surface thereof against a seating ring provided in the region of the catch bore with a withdrawal recess.

According to a further feature of the present invention the spring means which bias the levers to the locking position preferably comprise a pair of coil springs located beneath the levers and having each an arm engaging with an upwardly extending end a respective of the levers on a face thereof facing away from the other lever.

It is further advantageous if the region of the matrix shoe which carries the clamping levers is covered by a cover which is provided on the side thereof facing away from the matrix with an inlet opening of a width corresponding to the largest distance between the levers. This will assure that the region of the matrix shoe carrying the clamping levers is properly protected while permitting insertion of a tool below the cover for removal and exchange of the matrix and eventually also the cover.

The present invention relates also to a tool for moving the clamping levers to the releasing position and for withdrawing the matrix from the matrix shoe.

Such a tool preferably comprises first means movable between the levers for moving the same from the locking to the releasing position and second means for engaging the matrix for withdrawing the latter between the levers from the shoe. More specifically, the tool comprises a handle portion and an elongated portion extending transverse thereto and having an end face adapted to engage the peripheral surface of the matrix during movement of the tool in the longitudinal direction of the shoe towards the matrix. The aforementioned first means of the tool comprise an elongated slide fixed to the elongated portion and having transversely spaced side edges engaging and moving the levers to said releasing position and a free end portion located in the aforementioned withdrawal recess when the end face engaging the matrix, and the second means preferably comprise a withdrawal lever above the slide tiltable about an axis transverse to the elongation of the slide and a pin arranged to enter into the catch bore during tilting of the withdrawal lever towards the slide.

The withdrawal lever is preferably a two-armed lever provided on one arm thereof facing away from the matrix with a cam face and said tool further includes additional spring means biasing the lever in a direction in which the pin is out of engagement with the catch bore while means are mounted in the handle portion and cooperating with the cam face for tilting the withdrawal lever against the action of the additional spring means in a direction towards the slide so that the pin will enter into the catch bore to thus permit withdrawal of the matrix from the matrix shoe. Of course, the tool can also be used for insertion of a new matrix into the cutout of the matrix shoe by inserting the new matrix outside the machine between the slide and the withdrawal lever and by then moving the tool through the cutout toward the abutment face of the latter. Subsequently thereto the withdrawal lever is released so that the pin moves under the action of the further spring out of the catch bore, whereafter the tool with its slide is removed between the clamping levers out of the matrix shoe. The clamping levers will then engage under the action of the biasing springs with the end faces thereof the peripheral surface of the matrix to press the latter against the abutment face of the cutout.

If the arrangement is provided with the abovementioned cover, the latter is preferably formed in a wall portion thereof extending parallel to the slide with an opening therethrough and a second pin projecting from the withdrawal lever toward the slide is provided on the tool and arranged to penetrate into the opening of the cover during tilting of the withdrawal lever toward the slide.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
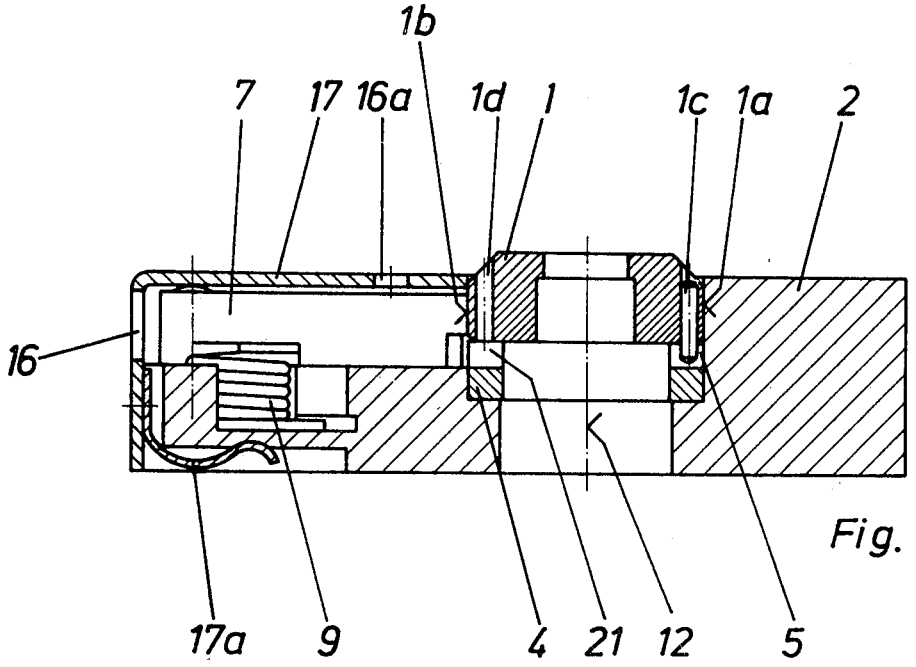
FIG. 1 is a longitudinal cross-section of the arrangement according to the present invention for exchangably mounting a matrix of circular cross-section in a cutout of a matrix shoe adapted to be mounted on a turnable of a revolving cutting press not illustrated in the drawing.
Figure 2:
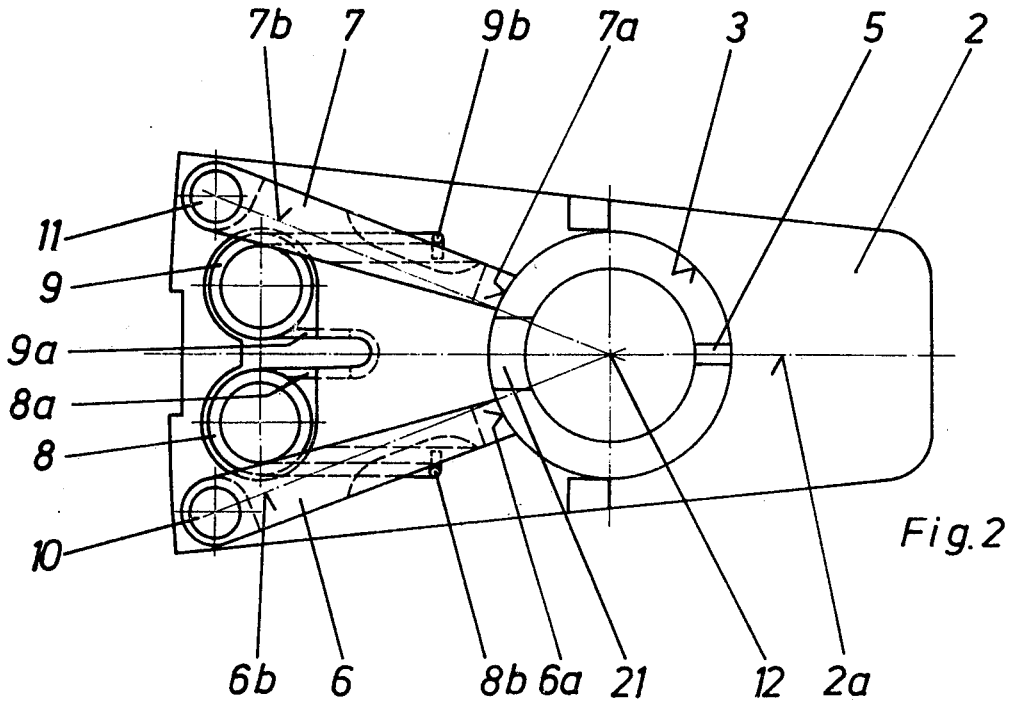
FIG. 2 is a top view of the arrangement shown in FIG. 1 with the matrix and the cover shown in FIG. 1 removed and in which the clamping levers are shown in the clamping position.

In the arrangement according to the present invention illustrated in FIGS. 1 and 2 the matrix 1 of usually circular cross-section is exchangably mounted in a matrix shoe 2. The matrix shoe is provided at its upper surface with an elongated cutout having an upwardly extending semicircular abutment face 3. The matrix 1 is pressed by clamping means to be described with part of its peripheral surface 1*a* against the abutment face 3. The matrix 1 is further arranged in the matrix shoe 2 on a seating ring 4 and secured against turning with respect to the latter by a pin 1*c* penetrating with the lower end portion thereof in an upwardly open cutout 5 of the seating ring. The matrix is further provided in a portion thereof opposite the abutment face 3 with a catch bore 1*d* extending parallel to the axis 12 of the matrix. The seating ring 4 is further provided in the region of the catch bore with a withdrawal recess 21 extending from the upper surface of the seating ring 4 through the wall thereof.

The clamping means which press in the clamping position thereof the matrix 1 against the abutment face 3 comprises two tiltable clamping levers 6 and 7 arranged from each other in transverse direction and mirror-symmetrically to the longitudinal axis 2*a* of the matrix shoe 2 and respectively tiltable at outer ends thereof about bolts 10 and 11 having axes parallel to the axis 12 of the matrix, so that the clamping levers 6 and 7 are tiltable in a plane normal to the longitudinal axis 12 of the matrix. The clamping levers 6 and 7 are under the action of coil springs 8 and 9 which are arranged in the region of the clamping levers 6 and 7 in the matrix shoe and the ends of which are respectively arranged in the matrix shoe at 8*a*, respectively 9*a*, whereas arms extending from the coil springs engage with upwardly extending end portions 8*b*, respectively 9*b*, the clamping levers 6 and 7 on side faces thereof directed away from each other. The springs 8 and 9 bias the clamping levers 6 and 7 in such a manner to tilt the free ends 6*a* and 7*a* toward each other so that the free ends 6*a* and 7*a* of the clamping levers 6 and 7 abut in the clamping position of the levers against the peripheral surface portion 1*b* of the matrix 1 to press the opposite surface portion 1*a* against the abutment face 3 of the cutout provided in the matrix shoe 2.

The clamping levers 6 and 7 are arranged and constructed in such a manner that a loosening of the matrix through cross-forces which will occur during operation of the tool is impossible. The clamping levers 6 and 7 are for this reason dimensioned and arranged so that the inner end faces 6*a* and 7*a* are arranged in the clamping position of the levers in such a manner so that lines 6*b*, respectively 7*b*, between the respective axes of the bolts 10 and 11 and the longitudinal axis 12 of the matrix will pass at least through inner end edges of the respective engaging faces 6*a* or 7*a*.

The portion of the matrix shoe 2 which carries the clamping levers is covered, as shown in FIG. 1, with a releasable cover 17, which is provided on the side thereof facing away from the matrix with an inlet opening 16 of a width corresponding to the largest distance between the levers 6 and 7. The cover 17 is additionally provided in its upper wall with an additional opening 16*a* for a purpose which will be described later on.

As evident from the description and the drawing, it is only necessary for exchange of the matrix 1 to outwardly tilt the clamping levers 6 and 7 against the action of the springs 8 and 9 by pushing a suitable element between the levers so that the matrix 1 will be released and may be removed from the shoe in the longitudinal direction of the latter.

Figure 3:
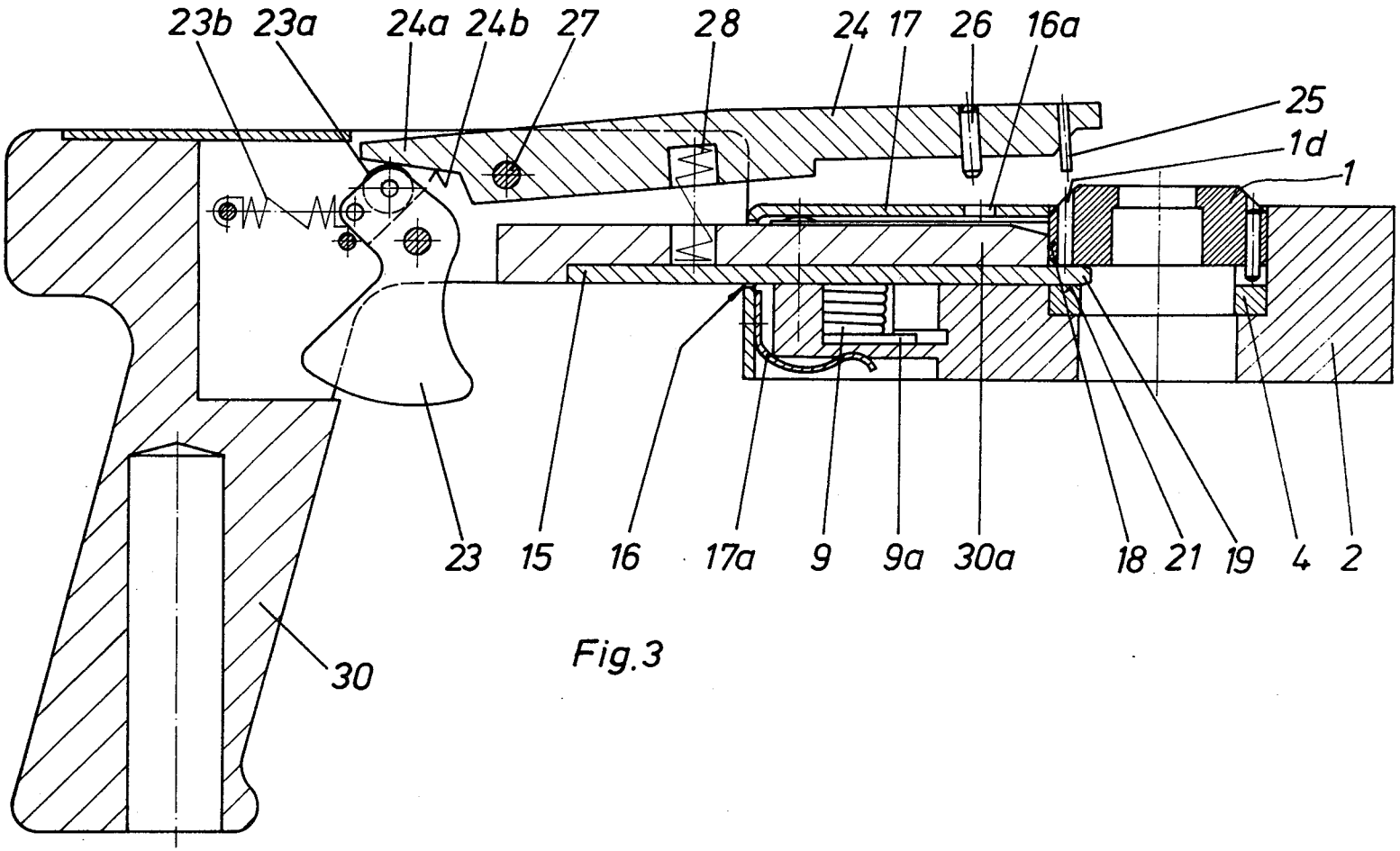
FIG. 3 is a longitudinal section through the matrix in the matrix shoe as per FIG. 1 and through a tool for removing the matrix shown in a position engaging the latter.
Figure 4:
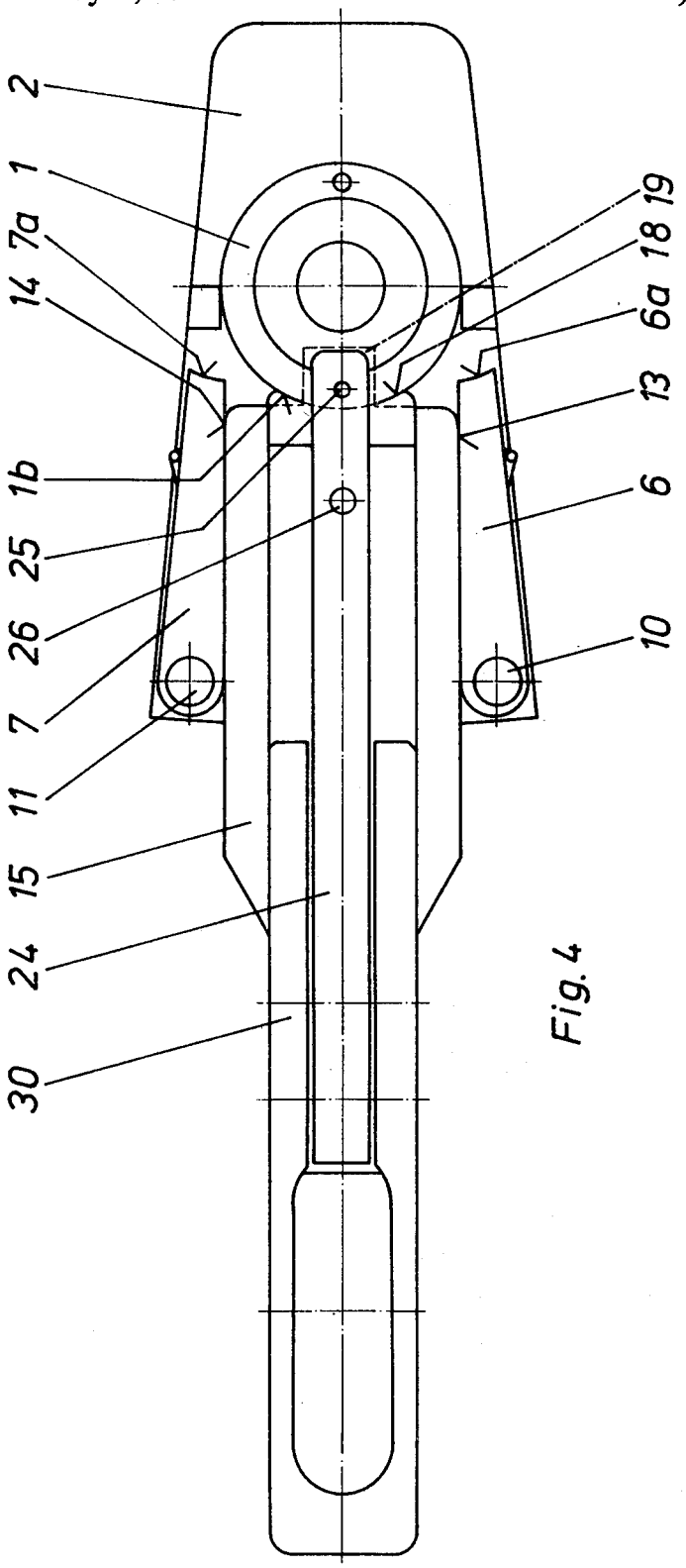
FIG. 4 is a top view of the tool and the matrix shoe with the cover removed.

FIGS. 3 and 4 illustrate an embodiment of a tool for exchanging a matrix in an arrangement of the already described kind, whereby in FIGS. 3 and 4 also the arrangement as shown in FIGS. 1 and 2 is illustrated.

The tool according to the present invention comprises a pistol-like shaped grip portion 30 from which a shank portion 30*a* projects to which an elongated slide 15 in the form of a plate is connected which is movable between the clamping levers 6 and 7 to spread the latter. The side edges 13 and 14 of the slide 15 are spaced transversely from each other in such a manner that during movement of the slide 15 between the clamping levers 6 and 7, the latter are outwardly tilted against the actions of the springs 8 and 9 to release the matrix 1, as clearly shown in FIG. 4. The front edge 18 of the shank 30*a* abuts thereby against the circumferential surface portion 1*b* of the matrix 1. A projection 19 of the slide penetrates thereby into the withdrawal recess 21 provided in the seating ring 4.

A two-armed withdrawal lever 24 is mounted above the slide 15 tiltable about an axis 27 extending transverse to the longitudinal direction of the slide. A withdrawal pin 25 extending normal to the lever 24 is mounted in the region of the free end thereof facing the matrix 1 in a position to enter the catch bore 1*d* when the lever 24 is tilted from its position shown in FIG. 3 toward the matrix 1. An additional withdrawal pin 26 is mounted on the lever 24 rearwardly of the pin 25 arranged for penetrating into the opening 16*a* of the cover 17 when the lever 24 is tilted toward the slide 15. A coil compression spring 28 seated at opposite ends in bores of the lever 28 and the shank 30*a* biases the lever to the position as shown in FIG. 3. The lever 24 is provided on its arm 24*a* facing away from the matrix 1 with an inclined cam face 24*b* which engages a roller 23*a* mounted on an actuating lever 24 pivotable about an axis parallel to the tilting axis 27 of the lever 24 so that by manually tilting the actuating lever 23 in clockwise direction, the withdrawal lever 24 is likewise tilted in this direction whereby the pins 25 and 26 respectively enter into the openings 1*d* and 16*a*.

The exchange of a matrix 1 by means of a tool as described above is carried out as follows:

While the actuating lever 23 is not actuated so that the withdrawal lever 24 will remain under the action of the spring 28 in the upwardly tilted position, the slide 15 and the shank 30*a* carrying the same are pushed through the entrance opening 16 in the cover 17 between the clamping levers 6 and 7 to spread the latter against the action of the springs 8 and 9 apart, so that the free ends 6*a* and 7*a* of the clamping levers are disengaged from the peripheral surface portion 1*b* of the matrix 1 and tilted outwardly to the position shown in FIG. 4. Thereby the projection 19 of the slide 15 enters into the withdrawal recess 21 of the seating ring 4 to be placed below the matrix 1. Subsequently thereto the withdrawal lever 24 is tilted against the action of the spring 28 in clockwise direction by actuating the actuating lever 23 so that the pins 25 and 26 respectively enter into the catch bore 1*d* of the matrix 1 and into the opening 16*a* of the cover 17, so that the matrix 1 as well as the cover 17 are connected with the tool. The tool is now withdrawn in the longitudinal direction of the slide 15, whereby the matrix 1 is taken along to be removed from the matrix shoe 2 and to be subsequently taken off from the tool. A new matrix can now be connected to the tool and subsequently be pushed against the abutment face 3 of the matrix shoe 2. The actuating lever 23 is then released so that the withdrawal lever 24 will tilt in upward direction as shown in FIG. 3 whereby the pins 25 and 26 leave the respective openings whereafter the tool is withdrawn in the longitudinal direction of the slide 15. The clamping levers 6 and 7 will tilt thereupon under the action of the springs 8 and 9 to the clamping position as shown in FIG. 2, properly clamping the matrix 1 in the matrix shoe 2. The cover 17 is held in releasable position by a spring 17*a* fastened to the inner surface of the front wall of the cover 17 and engaging a bottom face of the matrix shoe 2. The actuating lever 23 is normally held by a spring 23*d* in the position as shown in FIG. 3 in which the withdrawal lever is upwardly tilted.

The matrix shoe 2 is to be mounted on the non-illustrated turntable of the press in such a manner that the portion of the matrix shoe carrying the pivot bolts 10 ad 11 faces the outer periphery of the non-illustrated turntable with the longitudinal axes 2*a* of the matrix shoe 2 intersecting the axis of the turntable.

It will be understood that each of the elements described above, or two or more together, may also find a useful application in other types of arrangements for clamping matrixes on matrix shoes differing from the types described above.

While the invention has been illustrated and described as embodied in an arrangement for releasably clamping a matrix on a matrix shoe and a tool for withdrawing the matrix from the shoe it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as new and desired to be protected by Letters Patent is set forth in the appended claims:

1. A tool for withdrawing a matrix having an axis and a peripheral surface from a matrix shoe adapted to be mounted on a tool holder of a metal working machine and provided with a matrix seating ring and a pair of clamping levers which are pivotally movable between a clamping position in which the clamping levers clamp the matrix in the matrix shoe and a clearing position in which the clamping levers release the former from the latter and permit withdrawal of the matrix from the shoe, the shoe having an elongated cutout with an open end and an opposite abutment face, and the matrix having a catch bore and the matrix seating ring having a withdrawal recess and being located in the cutout with part of its peripheral surface pressed against the abutment face in said clamping position, the tool comprising tool means for pivotally moving said levers to said releasing position and for withdrawing said matrix from said matrix shoe, said tool means including first means movable between the levers for moving the same from the clamping to the clearing position, second means for engaging the matrix for withdrawing the latter between the levers from the shoe, and a pistol-shaped handle portion and an elongated portion projecting form an upper part of said handle portion and having an end face adapted to engage the peripheral surface of the matrix during movement of the tool means in the longitudinal direction of the shoe toward the matrix, said first means comprising an elongated slide fixed to said elongated portion and having transversely spaced side edges engaging and pivotally moving the levers to said releasing position and a free end portion located in the matrix seating ring withdrawal recess when said end face engages said matrix, and said second means comprising a withdrawal lever above said slide tiltable about an axis transverse to the elongation of the latter and a pin arranged to enter into the catch bore during tilting of said withdrawal lever toward said slide, said withdrawal lever being a two-armed lever, provided on one arm thereof facing away from the matrix with a cam face and on the other arm thereof with spring means biasing said withdrawal lever in a direction which said pin is out of engagement with the catch bore, and means mounted in said handle portion and cooperating with said cam face for tilting said withdrawal lever against the action of said spring means in a direction toward said slide so that said pin will enter into the catch bore.

2. An arrangement as defined in claim 1, wherein the matrix also has a releasable cover extending over the levers and provided on the side thereof facing away from the matrix with an inlet opening of a width corresponding to the largest distance between the levers and with a further opening extending therethrough, said withdrawal lever having a second pin projection extending toward said slide means and arranged to penetrate into the further opening of the cover during tilting of said withdrawal lever toward said slide.

* * * * *